United States Patent [19]

Krauer

[11] 4,142,275

[45] Mar. 6, 1979

[54] SLIDE FASTENERS

[76] Inventor: Alwin Krauer, 111 E. Chestnut, Chicago, Ill. 60611

[21] Appl. No.: 796,995

[22] Filed: May 16, 1977

[51] Int. Cl.[2] ..... A44B 19/26

[52] U.S. Cl. ..... 24/205.15 R

[58] Field of Search ..... 24/205.15 R, 205.15 E, 24/205.14 R

[56] References Cited

U.S. PATENT DOCUMENTS

| | | | |
|---|---|---|---|
| 1,585,645 | 5/1926 | Binns | 24/205.15 E |
| 2,119,352 | 5/1938 | Puc | 24/205.14 R |
| 2,181,142 | 11/1939 | Marinsky | 24/205.15 R |
| 2,810,174 | 10/1957 | Mikulas | 24/205.15 R |
| 2,824,352 | 2/1958 | Foltis | 24/205.15 R |
| 2,870,507 | 1/1959 | Poux | 24/205.15 R |
| 2,905,996 | 9/1959 | Jones | 24/205.15 R |
| 2,933,792 | 4/1960 | Malmborg | 24/205.15 E |

*Primary Examiner*—Bernard A. Gelak
*Attorney, Agent, or Firm*—Alter and Weiss

[57] ABSTRACT

An improved slide fastener for coupling garment portions together. The slide fastener construction including extending parallel tines designed for preventing the garment or parts of the garment or threads therein from jamming the slider as the slider is moved along for fastening or unfastening the garment.

7 Claims, 8 Drawing Figures

SLIDE FASTENERS

The present invention relates in general to slide fasteners and, more particularly, to improvements in slide fasteners that are for preventing jamming of such fasteners due to entanglement of the fabric or threads of the garment with the fastening elements of the slide fastener, or between the fastening elements and the slider of the slide fastener.

Slide fasteners generally have two interfacing spaced apart tapes, each carrying an interengageable row of engaging or fastening elements. Each of the rows has an interior and exterior surface. A slider is provided that moves along the two tapes simultaneously and causes the engagement of the rows of fastening elements or the disengagement of those rows depending on whether the slider is being moved to close or open the slide fastener.

One of the continuing problems involved with the use of slide fasteners is that they often jam due to extraneous fabric or thread being caught between the engaging elements of the tapes or between the slider and the engaging elements. In the prior art, there are numerous devices designed to prevent such jamming. An example of such devices is seen in U.S. Pat. No. 2,905,996, which issued to Ralph Jones on Sept. 29, 1959. Jones teaches a pair of prongs extending frontwardly and rearwardly of the slider. The prongs ride along the tapes to push threads and extraneous material away from the slider and thus prevent the jamming problem. However, even with the Jones solution the slider and slide fastener are still susceptible to jamming by extraneous fabrics and threads which become lodged between the slider and the tapes along the forward sides of the slider. The Jones prongs are too far removed from the entry point of the tapes through the slider to adequately perform the jamming prevention function for which they were designed. In addition, the Jones slide fastener does not prevent fabric and extraneous threads from becoming lodged between the interengageable elements of the tapes. The prongs of the Jones device extend to the side of the slider along the tapes but do not extend to the vicinity of the actual engagement of the engageable elements. Thus, any threads that are fortuitously located between the elements before the engagement of the engageable elements become jammed within the elements and the slide after engagement.

In addition to the Jones type extended prong device, the prior art has also used numerous attachable guards; such as is shown in the Koehler U.S. Pat. No. 2,911,699, which issued on Nov. 10, 1959. Therein a guard attached to the slider extends in the front thereof. The guard shown by Koehler is a unitary piece designed to prevent the cover flap from jamming the slide fastener. However, the problem is that the Koehler guard does not prevent threads or miscellaneous parts of the garment from snagging on the slide fastener because the guard is too far removed from the actual interlocking elements.

Accordingly, it is an object of the present invention to provide a guard system to prevent the cover flap of the garment being snagged by the slide fastener and other extraneous fabrics or threads from snagging in the slide fastener.

Accordingly, a related object of the invention is to prevent snagging of materials, fabrics, or threads in a slide fastener through the use of extending teethlike tines.

Another related object of the present invention is to provide sliders having teethlike tines extending from the front and sides of the slider. The tines are designed to obstruct the entrance of any extraneous materials at the openings of the slider without obstructing the ingress and egress of the interlockable elements of the slide fastener tapes relative to the slider.

Yet another object of the present invention is to provide an extraneous cloth removing front extension for the slider to force all extraneous material away from the tapes and slider to enable the slider to pass and interlock the elements of the tapes without interference.

A related object of the present invention is to provide sliders having extensions at the sides and front. The extensions are in part teethlike tines which protrude both at the bottom and top of the slider. The teeth engage any extraneous material and comb it away from an interfering position with the slider thus preventing the snagging of that material and the jamming of the slide fastener. The snag preventing elements may be located on a separate applique or may be integral to the slider. In either case, the snag preventing elements do not interfere with the passage of the tape through the slider but filter away any extraneous, possibly snagging materials.

In accordance with one embodiment of the present invention, the slider of the slide fastener is provided with teeth extending outwardly from the top and bottom slider plates. The teeth are parallel to each other. The front teeth are slightly curved upward to assure that there is no interference with the slide fastener tapes having the interlocking elements thereon. The teeth are designed to engage any extraneous material and "comb" it away from the slider path. This prevents even normally resilient materials from returning to a snagging position in relation to the slider until the slider passes.

Another preferred embodiment utilizes an applique type snag preventing device having a top and bottom plate which contain the extending teeth for combing possibly snagging material away from the following slider. The extension plates do not cause the interlocking elements of the tapes to interlock; instead, the applique is coupled to the slider and clears the track for the slider.

The above-mentioned and other objects and features of the present invention will become apparent from the following description reference being made to the accompanying drawings, in which.

Figure 1:
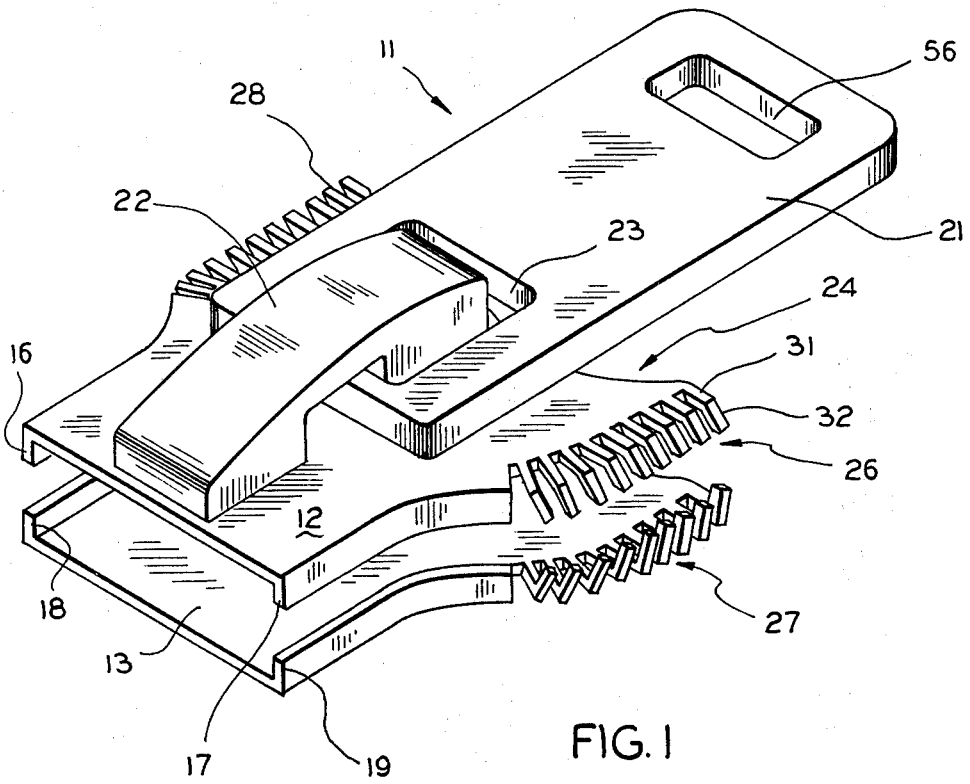
FIG. 1 is a pictorial showing of the slider of the improved slide fastener.
Figure 4:
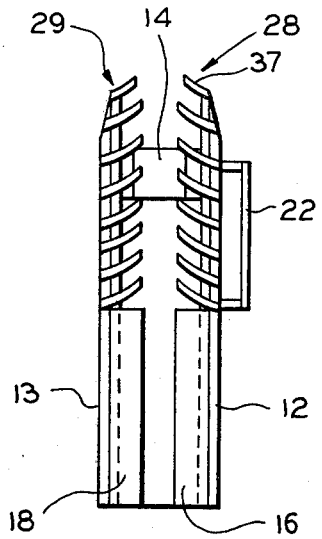
FIG. 4 is a side view of the slider of FIG. 3.

The slider shown generally as 11 in FIG. 1 is comprised of a pair of spaced apart parallel planar elements. The top planar element is shown as 12 and the bottom planar element is shown as 13. The planar elements are joined together by a neck which appears as neck 14 in FIGS. 2, 4, and 5. Each of the planar elements has a pair of spaced apart flanges running normal to the associated planar element and extending toward the opposite planar element. The flanges are shown as flanges 16 and 17 extending downward from the top planar element 12 toward the bottom planar element 13; the flanges 18 and 19 extending upward from the bottom planar element 13 toward the top planar element 12. These flanges taper inwardly from the front or neck section of the slider to the back section of the slider. Thus, the flanges 16 and 17 and the flanges 18 and 19 are closer together at the back side of the slider where seen in FIG. 1 than at the front of the slider which is not shown in FIG. 1. The taper is, of course, what causes the joinder to interlocking elements on the tapes which are sewn to the cloth to be fastened together.

Means are provided for moving the slider. More particularly, a tablike handle 21 is attached to the top planar element using means such as attachment loop 22. The tab handle has an attachment loop connecting aperture 23 which enables moving the tab handle to the front of the slider or to the rear of the slider to move the slider frontwardly, which is in the locking direction, or rearwardly, which is in the unlocking direction. The attachment loop is shown as being permanently affixed to the top planar element. This is done by means such as molding a unitary element or welding the loop to the top planar element.

Means are provided for preventing the slide fastener from being jammed by an extraneous fabric or threads entering between the slider and the strips of lockable elements. More particularly, the lead end of the slider indicated as 24, is curved forwardly from the handle loop portion 22. Also, teethlike tines are provided at the forward side sections 26, 27, 28, and 29. These teethlike tine sections go from the lead ends until approximately midway down the slider.

The teethlike tine sections, in a preferred embodiment, are made up of substantially L-shaped teeth. The teeth extend sideways in the same plane as the planar sections 12 and 13 and at the ends of the teeth they include a section normal to the planar section and extend toward the opposite planar section. For example, the first tooth, among tines 26, has a section 31 integral to and in the same plane as the planar section 12. Normal to section 31 and extending downward from section 31 is the right-angle section 32. The right-angle section 32 is slanted toward the front so that the teeth each extend outwardly and forwardly from the point of the planar section at which it is integrally attached. This aids in preventing the slider from snagging extraneous materials.

In a preferred embodiment, the teeth of each side of the slider are substantially parallel to each other and in opposition to the teeth extending from the opposite planar section. In the plan view of FIG. 3, it is seen that the center of the lead section 24 of the slider is rearward of the tine sections. The center 33 is defined by a transverse straight line, i.e., a line that is transverse to the direction of motion of the slider. Extending on each side of section 33 are slanted sections 34 and 36 which extend forward of section 33. Finally, the teeth sections are indicated at the teeth 31 and 37 at opposite sides of the forward end of the slider. The forward extending teeth mounted forward of the flange sections provides a front shield for the slider to protect the slider from penetration by extraneous materials and thus to minimize the snagging and jamming which would otherwise occur.

As is shown in FIGS. 1, 3, 4, and 5, the tine sections, such as sections 28 and 29, extend downward at the forward periphery of the planar sections and toward the opposite planar section. Thus, the teeth of each of the tine groupings are matched and opposed to each other. Immediately rearward of the tine sections 28,29 are the solid flanges, shown as flanges 16 and 18. The flanges, of course, are tapered as shown particularly in FIGS. 5 and 3. The front shape of the slider has a "cow-catcher" effect and clears the strips of the interlocking elements in front of the tapered portion of the slider to thereby minimize any snagging of an extraneous materials.

Figure 3:
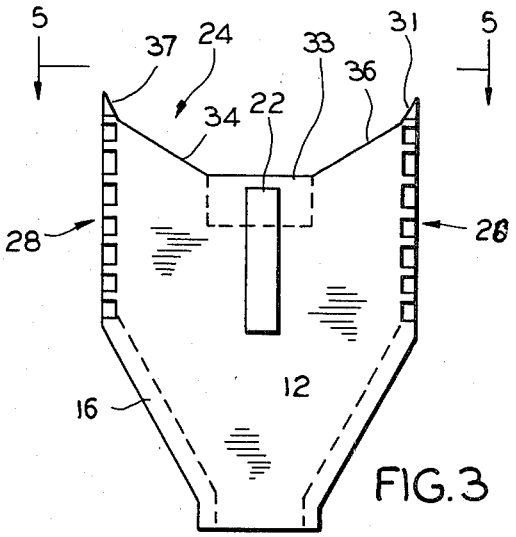
FIG. 3 is a plan view of the slider of FIG. 1 with the handle portion removed.
Figure 5:
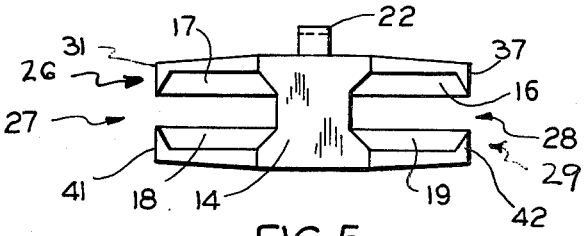
FIG. 5 is a front view of the slider of FIG. 3, looking in the direction of the arrow 5—5 in FIG. 3.

FIG. 3 shows the taper where, for example, teeth 31 and 37 are part of the tine sections 26 and 28 which eventually merge into the flanges 17 and 16. Similarly, the bottom front teeth 41 and 42 of the tine sections 27 and 29 eventually merge into flanges 19 and 18. This is shown in FIG. 5. The strips of interlockable elements which may have extraneous material on them are traversed by the slider with its "cow-catcher" front guard and extending teethlike tines protecting the front and sides of the slider to minimize snagging.

Figure 7:
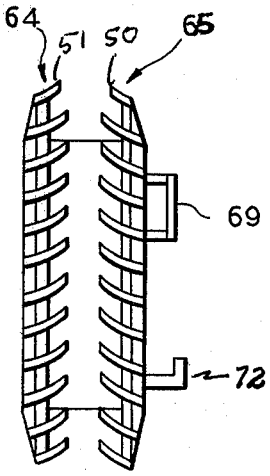
FIG. 7 is a side view of the snag preventing applique of FIG. 6.
Figure 6:
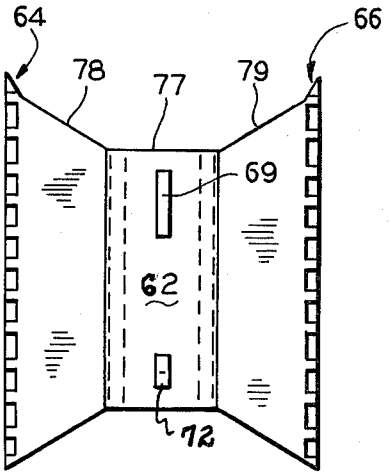
FIG. 6 is a plan view of the snag preventing applique of FIG. 2, without the handle or slider attached.
Figure 8:
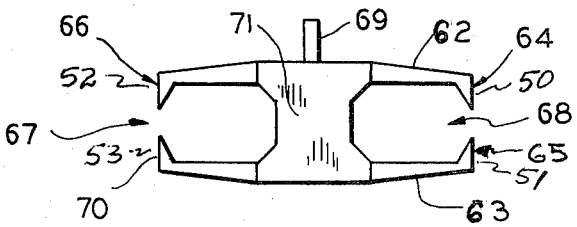
FIG. 8 is a front view of the snag preventing applique of FIG. 6.

Means are provided for protecting the prior art sliders from snagging on extraneous materials. More particularly, a snag preventing attachment or applique is provided and shown as snag preventing applique 61 attached to a slider 47. The views of FIGS. 6, 7, and 8 show one preferred embodiment of the snag preventing applique. Therein, as seen in FIG. 6, a top planar section 62 and a bottom planar section 63 are provided. Extending upward from the bottom section 63 and downward from the top section 62 are spaced apart opposed sections 64 and 66 and 69 and 70. These sections are tined, i.e., are made up of groups of comblike teeth and provide room for the strips of locking elements to pass between the tine sections 64,66 and 69,70 of planar sections 62,63. The characterized tine sections clear the strips of lockable elements from extraneous materials and, thus, minimizes snagging and jamming at the slider because of the extraneous materials. Also rising from the planar section 62 is a tab loop 69 to which a handle tab 71 is attached. Also extending upward from planar section 62 is a slider tab receiving post element 72. This is designed to receive the slider tab 74 by having the aperture 76 of the tab 74 fit over post 72 locking the slider 73 to the snag preventing attachment 61. The post 72 may have a shoulder to aid in locking the slider to the applique.

The embodiment of FIGS. 2, 6, 7, and 8 shows the snag preventing applique having top and bottom planar sections 62 and 63 with each top and bottom planar section equipped with a set of teethlike tines 64 and 65. The tines extend downwardly from the planar section toward each other. Each of the tines is slanted frontwards in addition to extending downwardly. Thus, the teeth extend in front of the planar sections as well as out to the sides of the planar sections, thereby being in a position to force extraneous materials away from running in between the planar sections. Since the strips of interlocking elements running between the planar sections of the snag preventing applique goes into the slider, extraneous material is prevented from coming into contact with the slider. The front four teeth, such as teeth 50, 51, 52, and 53 are curved upward slightly at their bottom to facilitate threading the strips of interlocking elements through the snag preventing applique.

Figure 2:
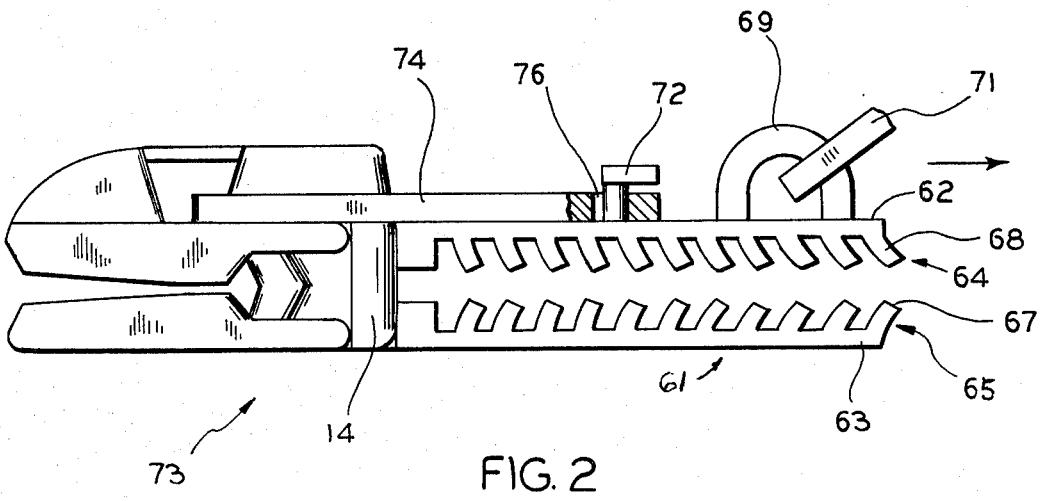
FIG. 2 is a side view of the snag preventing applique and a portion of the slider attached thereto.

An ordinary slider 73 is shown attached to the snag preventing applique of FIG. 2. The tab handle 74 of the slider has an aperture 76 which fits over post 72 so that when the applique is pulled in the slide fastener locking direction, shown by the arrow, the slider is also pulled in that direction. As can be seen from the Figures, the tine sections 64 and 66 extend from the front of the applique all the way to the rear of the applique. This enables forcing extraneous materials out of the way up until the minute the strips of interlocking elements pass into the slider.

The plan view of FIG. 6 illustrates a portion of the applique that is transverse to the direction of motion of the slider. This section is denoted as section 77. Section 77 is flanked by two slant portions 78 and 79 extending forward and sideward of section 77.

The handle 74 of the slide fastener is placed with its aperture 76 over the post 72. A handle 71 on loop 69 is then pulled, pulling the extension portion and the slider of the slide fastener.

In FIG. 8, the front view of the applique is shown. Therein can be seen the spaces 67,68 into which the strips of interlocking elements pass.

Both sets of oppositely disposed spaced teethlike tine sections are shown as 66 and 70 on one side and 64 and 65 on the other side. The mid-section 71 holds the two planar sides 72 and 73 spaced apart from each other. In operation then, the snag preventing attachment is placed juxtaposed to the actual slider with the strips placed in spaces 67 and 68. The tab handle of the slider is put over the post 72 of the attachment. The handle of the attachment 74 is then pulled which causes the applique in front of the slider to clear any extraneous material from the path of the slider. The slider forces the interlocking elements together. Thus, in using the attachment, snags are minimized and the frustrating event of a snag locked slider is prevented.

While the principles of the invention has been described above in connection with specific apparatus and applications, it is to be understood that this description is made only by way of example, and not as a limitation on the scope of the invention.

What is claimed is:

1. An improved slide fastener for coupling garment portions together, said slide fastener comprising:

slider means;

said slider means having a pair of spaced apart opposed co-planar sections;

said co-planar sections each having a tapering flange section for use in selectively locking together opposing rows of interengageable elements, to thereby coupled the garment portions together;

snag preventing means for preventing extraneous material from jamming said slider means, and said snag preventing means comprising opposing rows of teeth-like tines extending from the periphery of the snag preventing means forward of said tapering sections.

2. The improved slide fastener of claim 1, wherein said snag preventing means comprises an applique having teethlike tines thereon.

3. The improved slide fastener of claim 2, wherein said applique comprises a pair of spaced apart planar elements, teethlike tines on the side peripheries of each of said elements, said teethlike tines extending forward of the mid-section of said applique, and means for coupling said applique to said slider.

4. The improved slide fastener of claim 1, wherein said teethlike tines extend sidewards and forward from said slider.

5. An improved slide fastener for coupling garment portions together, said slide fastener comprising:

slider means;

said slider means having a pair of spaced apart opposed co-planar sections;

said co-planar sections each having a tapering flange section for use in selectively locking together opposing rows of interengageable elements, to thereby couple the garment portions together;

snag preventing means for preventing extraneous material from jamming said slider means, said snag preventing means comprising teeth-like tines extending forward of said tapering sections, said snag preventing means comprising an applique having teeth-like tines thereon, said applique comprising a pair of spaced apart planar elements, said teeth-like tines located on the side periphery of each of said elements, said teeth-like tines extending forward of the mid-section of said applique, means for coupling the slider to said applique comprising post means on said applique, handle means on said slider, and an aperture in said handle means for fitting over the post means in said applique, thereby coupling said applique to said slider.

6. The improved slide fastener of claim 5, wherein said applique is dimensioned so that when said slider handle fits over said post, the end of said applique is contiguous to the beginning of said slider.

7. The improved slide fastener of claim 6, wherein the forward teeth of said teethlike tines are curved slightly upward to enable the ingress and engress of said opposing rows of interengageable elements.

* * * * *